US008777213B2

(12) United States Patent
Shimohora

(10) Patent No.: US 8,777,213 B2
(45) Date of Patent: Jul. 15, 2014

(54) RECORDING MEDIUM STORAGE CASSETTE AND IMAGE FORMING APPARATUS INCLUDING THE SAME

(75) Inventor: Yuuya Shimohora, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 174 days.

(21) Appl. No.: 13/233,511

(22) Filed: Sep. 15, 2011

(65) Prior Publication Data

US 2012/0104687 A1 May 3, 2012

(30) Foreign Application Priority Data

Nov. 2, 2010 (JP) ..... 2010-245808

(51) Int. Cl.
*B65H 1/00* (2006.01)

(52) U.S. Cl.
USPC ..... 271/145; 271/167; 271/169

(58) Field of Classification Search
USPC ..... 271/145, 169, 167
See application file for complete search history.

(56) References Cited

U.S. PATENT DOCUMENTS

| | | | | |
|---|---|---|---|---|
| 7,775,516 | B2 * | 8/2010 | Miwa | 271/145 |
| 2005/0017436 | A1 * | 1/2005 | Hung | 271/145 |
| 2008/0169600 | A1 * | 7/2008 | Shimizu et al. | 271/145 |
| 2013/0049290 | A1 * | 2/2013 | Matsumoto | 271/145 |

FOREIGN PATENT DOCUMENTS

| | | | |
|---|---|---|---|
| JP | 3-56338 | A | 3/1991 |
| JP | 3-88630 | | 4/1991 |
| JP | 4-209137 | | 7/1992 |
| JP | 6-28515 | | 8/1994 |
| JP | 2006-219243 | A | 8/2006 |
| JP | 2006-232552 | A | 9/2006 |

OTHER PUBLICATIONS

Japanese Office Action for Application No. 2010-245808 mailed on Mar. 19, 2013.

* cited by examiner

*Primary Examiner* — Michael McCullough
*Assistant Examiner* — Howard Sanders
(74) *Attorney, Agent, or Firm* — Smith, Gambrell & Russell LLP

(57) ABSTRACT

In a sheet feeding cassette (10), wall portions (25*a* to 25*d*) are provided upright at four peripheral end portions of a cassette base (25). Of the wall portions (25*a* to 25*d*), the wall portion (25*a*) positioned on a downstream side in a sheet feeding direction has a first notch portion (41) formed at a substantially center portion in a longitudinal direction of the wall portion (25*a*), the first notch portion (41) facing a feeding roller (30*a*) provided on an image forming apparatus (100) main body side.

7 Claims, 4 Drawing Sheets

--Related Art--

--Related Art--

RECORDING MEDIUM STORAGE CASSETTE AND IMAGE FORMING APPARATUS INCLUDING THE SAME

BACKGROUND OF THE INVENTION

This application is based upon and claims the benefit of priority from the corresponding Japanese Patent Application No. 2010-245808 filed on Nov. 2, 2010, the entire contents of which are incorporated herein by reference.

1. Field of the Invention

The present invention relates to a recording medium storage cassette for storing a recording medium of a sheet form, which is to be used in an image forming apparatus such as a digital copying machine and a laser printer, and to an image forming apparatus including the recording medium storage cassette.

2. Description of Related Art

Conventionally, there has been widely used a sheet feeding cassette for storing a plurality of stacked sheets (recording media) and for conveying the sheets one by one in a separated manner to an image forming portion of an image forming apparatus main body in accordance with an image forming operation.

A configuration of a conventional sheet feeding cassette is described. FIG. 5 is a cross-sectional side view of a conventional sheet feeding cassette 10. A bundle of sheets 26 set in a cassette base 25 of the sheet feeding cassette 10 are pressed against a pickup roller 29, which is provided on an apparatus main body side, at a predetermined pressure, owing to the elevation of a sheet stacking plate 28 which is vertically raised and lowered by a lifting mechanism (not shown). Here, when a printing operation of the image forming apparatus is started, the pickup roller 29 and a feeding roller 30*a* of a feeding roller pair 30 are driven and rotated in directions indicated by the arrows of FIG. 5.

Generally, several sheets 26 on the upper side of the bundle set on the sheet stacking plate 28 are fed to the feeding roller pair 30 by the pickup roller 29. The feeding roller pair 30 includes the feeding roller 30*a* and a separation roller 30*b* which is provided in press-contact to or apart from the feeding roller 30*a*. The separation roller 30*b* has a torque limiter built therein, and is rotated with the feeding roller 30*a* in accordance with the rotation thereof only when the rotational load exceeds the predetermined torque. The separation roller 30*b* separates only the uppermost sheet of the several sheets fed to the feeding roller pair 30, to thereby convey the sheet toward a sheet conveyance path 11. The cassette base 25 is provided with a trailing end cursor 31 for aligning the trailing ends of the sheets 26, the trailing end cursor 31 being movable in a sheet conveyance direction (lateral direction in FIG. 5).

In the sheet feeding cassette 10 described above, there has been a problem that, when the bundle of the sheets 26 are set on the sheet stacking plate 28, or when the sheets 26 once set are removed and then the sheets 26 having different size or paper quality are reset, the workability is lowered because a wall portion provided upright at a peripheral end portion of the cassette base 25 disturbs the work.

In this context, there have been proposed various sheet feeding cassettes which enable smooth supplying and removing of the sheets with respect to the sheet feeding cassette. For example, there is known a configuration in which a notch portion is provided from the side surface to the bottom surface of the sheet feeding cassette so that at least a hand is insertable. Further, there is also known a configuration in which a sheet abutment portion (trailing end cursor), which is integrally formed with a cassette plate (sheet stacking plate), is notched in part so as to provide a finger inserting portion.

By the way, when the sheet is fed from the sheet feeding cassette as described above, there is a problem that a flapping noise of the sheet trailing end is generated. Specifically, when one sheet 26 is conveyed toward the sheet conveyance path 11, as illustrated in FIG. 6, after passing through a nip portion between the pickup roller 29 and the sheet stacking plate 28, a trailing end 26*a* of the sheet 26 being conveyed is hit to an upper end of a wall portion 25*a* positioned in a sheet feeding direction of the cassette base 25 by the restoring force of the sheet 26. Thus, a sheet conveyance noise (flapping noise) is generated.

This flapping noise is a so-called impulse response, which corresponds to a momentarily generated high-pitched sound, and hence is extremely annoying for a user. In recent years, there has been an increasing demand for noise-reduction, and therefore a measure against the flapping noise of the sheet trailing end, which is one of the factors of noise, has become important. However, with the above-mentioned method of providing the notch portion in the side surface of the sheet feeding cassette or a part of the trailing end cursor, it has been incapable of reducing the flapping noise of the sheet trailing end.

As a conventional measure, a member having cushioning properties such as an elastic body is fixed to a place to which the sheet trailing end is hit, to thereby reduce the flapping noise. However, because of the addition of the member, this method causes increase in material cost and manufacturing cost, and further, there is a fear that the fixed member causes harmful effects such as a jam of the sheet.

As a method of reducing the flapping noise of the sheet trailing end, for example, there is known a sheet feeding apparatus in which a plurality of ribs are formed on a guide surface of a turn guide which reverses the sheet fed from the sheet cassette and guides the reversed sheet to an image transfer portion, and a projected portion of the rib, which is projected toward the leading end of the sheet cassette, is shaped so as to become lower toward both ends from a center of the turn guide.

However, the above-mentioned technology is a technology for preventing generation of the flapping noise caused by the collision of the turn guide and the trailing end of the sheet fed from the sheet cassette, and is not a technology for preventing the flapping noise caused by the collision of the sheet trailing end and the wall portion of the sheet cassette. Further, although the sheet is conveyed in the sheet feeding direction while the center portion in the width direction thereof, which is nipped between the feeding roller pair, bends downwardly, in the above-mentioned sheet feeding apparatus, the rib at the center of the turn guide has the largest height. Thus, there has not been disclosed any technological idea for avoiding the collision of the sheet and the rib in consideration of the sheet bending.

SUMMARY OF THE INVENTION

The present invention has been made in view of the above-mentioned problems, and it is an object of the present invention to provide a recording medium storage cassette, which is capable of effectively reducing a flapping noise of a recording medium trailing end when the recording medium is fed and in which a recording medium setting property is improved, with a simple configuration and at low cost.

In order to achieve the above-mentioned object, according to one aspect of the present invention, there is provided a recording medium storage cassette, including: a housing, which is constituted by a cassette base and a plurality of wall portions provided upright at peripheral end portions of the cassette base, for storing a recording medium of a sheet form; and a recording medium stacking plate, which is pivotably provided to the housing and has one end raised and lowered in accordance with a stacking amount of the recording medium; and a first notch portion, which is formed in, among the plurality of wall portions, a wall portion provided upright in a feeding direction of the recording medium, the first notch portion being opened toward an upper end of the wall portion and formed at a position facing a feeding roller, which is provided on the image forming apparatus main body side, for feeding the recording medium inside the housing, the recording medium storage cassette being detachably mountable to an image forming apparatus main body.

Further features and advantages of the present invention will become apparent from the description of embodiments given below.

DETAILED DESCRIPTION OF PREFERRED EMBODIMENT

Figure 1:
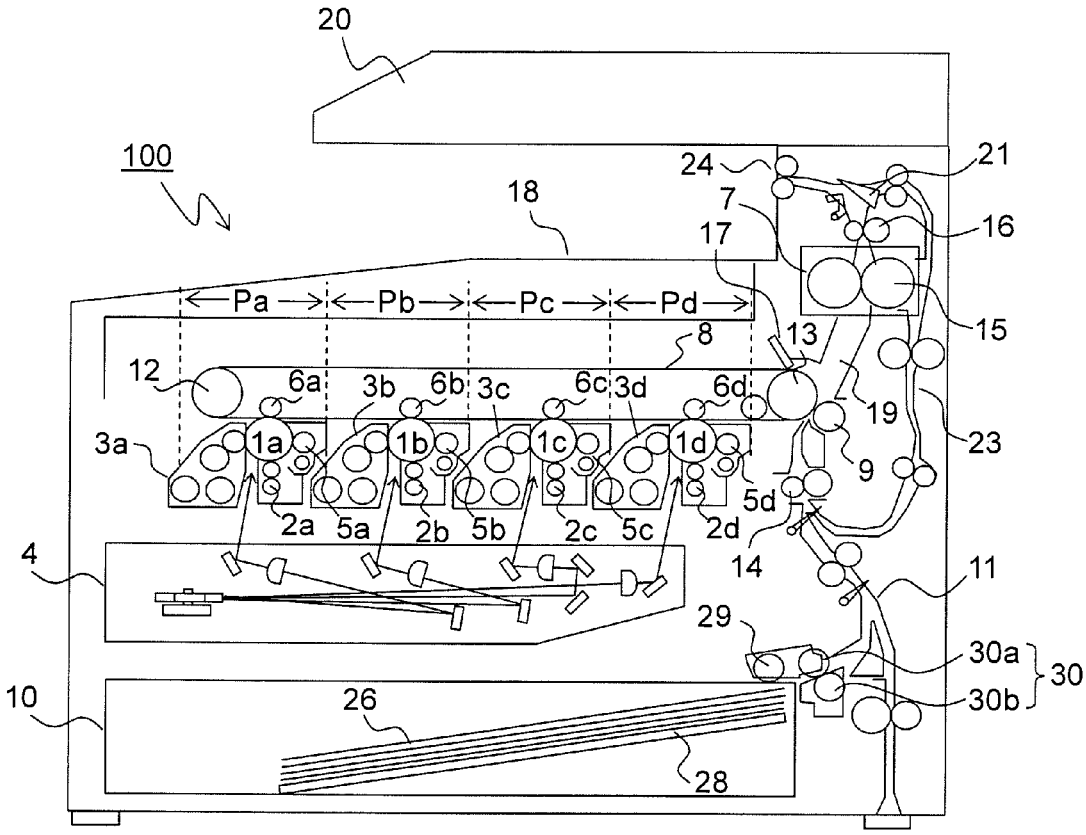
FIG. 1 is a schematic cross-sectional view illustrating an inner configuration of an image forming apparatus 100 to which a sheet feeding cassette 10 according to the present invention is mounted.

Hereinafter, an embodiment of the present invention is described in detail with reference to the drawings. FIG. 1 is a schematic view illustrating an inner configuration of an image forming apparatus 100 to which a sheet feeding cassette 10 according to the present invention is mounted. The image forming apparatus 100 is a tandem-type color copying machine, and includes four image forming portions Pa, Pb, Pc, and Pd inside an image forming apparatus 100 main body, which are arranged in the stated order from the left side in FIG. 1. The image forming portions Pa to Pd are provided correspondingly to images of four different colors (yellow, magenta, cyan, and black), respectively, and the respective yellow, magenta, cyan, and black images are sequentially formed by respective steps of charging, exposure, development, and transfer.

Those image forming portions Pa to Pd are respectively provided with photosensitive drums 1*a*, 1*b*, 1*c*, and 1*d* for bearing visible images (toner images) of the respective colors. Further, an intermediate transfer belt 8, which rotates in a counterclockwise direction in FIG. 1, is provided so as to be adjacent to the respective image forming portions Pa to Pd. The toner images formed on the photosensitive drums 1*a* to 1*d*, respectively, are sequentially transferred and superimposed on the intermediate transfer belt 8 which moves while being held in abutment with the respective photosensitive drums 1*a* to 1*d*. After that, the toner images are transferred onto a sheet 26 as an example of a recording medium by the action of a secondary transfer roller 9, and further, fixed on the sheet 26 in a fixing device 7. Then, the sheet 26 is delivered from the apparatus main body. The image forming process with respect to the respective photosensitive drums 1*a* to 1*d* is executed while rotating the photosensitive drums 1*a* to 1*d* in a clockwise direction in FIG. 1.

The sheets 26 onto which the toner image is to be transferred are stored in the sheet feeding cassette 10 provided on the lower side of the apparatus. The sheets 26 are stacked on a sheet stacking plate 28 of the sheet feeding cassette 10, and feeding of the sheets 26 is started by rotating a pickup roller 29 under a state in which the upper surface of the sheet 26 is held in press-contact with the pickup roller 29 at a predetermined pressure. Then, a feeding roller pair 30 separates only the uppermost sheet of the several sheets 26, to thereby convey the sheet toward a sheet conveyance path 11. The sheet 26 passes through the sheet conveyance path 11, and then reaches to a registration roller pair 14. Then, at an appropriate timing for image formation, the sheet 26 is conveyed to a nip between the secondary transfer roller 9 and a drive roller 13 for the intermediate transfer belt 8 described later.

A dielectric resin sheet is used for the intermediate transfer belt 8, and both end portions of the dielectric resin sheet are overlapped and bonded to each other to form an endless belt, or a seamless belt is used. Further, on a downstream side in a moving direction of the intermediate transfer belt 8 when viewed from the secondary transfer roller 9, a cleaning blade 17 for removing toner remaining on the surface of the intermediate transfer belt 8 is arranged.

An image reading portion 20 includes a scanning optical system in which a scanner lamp for illuminating an original at the time of copying and a mirror for changing an optical path of light reflected from the original are mounted, a condensing lens for condensing the light reflected from the original to form an image, and a CCD sensor for converting the formed image light into an electrical signal (all members are not shown). The image reading portion 20 reads the image on the original and converts the read image into image data.

Next, the image forming portions Pa to Pd are described. In the periphery of or below the rotatably provided photosensitive drums 1*a* to 1*d*, there are provided charging devices 2*a*, 2*b*, 2*c*, and 2*d* for charging the photosensitive drums 1*a* to 1*d*, respectively, an exposure device 4 for performing exposure of image information onto the respective photosensitive drums 1*a* to 1*d*, development devices 3*a*, 3*b*, 3*c*, and 3*d* for forming toner images onto the photosensitive drums 1*a* to 1*d*, respectively, and cleaning devices 5*a*, 5*b*, 5*c*, and 5*d* for removing a developer (toner) remaining on the photosensitive drums 1*a* to 1*d*, respectively.

When the image data is input from the image reading portion 20, first, the surfaces of the photosensitive drums 1*a* to 1*d* are uniformly charged by the charging devices 2*a* to 2*d*, respectively, and then, light beams are applied by the exposure device 4 correspondingly to the image data, to thereby form electrostatic latent images onto the respective photosensitive drums 1*a* to 1*d* correspondingly to the image date from the image reading portion 20. The development devices 3*a* to 3*d* include development rollers (developer carrying members) arranged so as to be opposed to the photosensitive drums 1*a* to 1*d*, respectively, and are respectively loaded with predetermined amounts of two-component developers containing toners of the respective colors of yellow, magenta, cyan, and black. Those toners are supplied and electrostatically adhered onto the photosensitive drums 1*a* to 1*d* by the development rollers of the development devices 3*a* to 3*d*, to thereby form toner images corresponding to the electrostatic latent images formed by the exposure from the exposure device 4.

Then, with primary transfer rollers 6*a* to 6*d*, an electrical field is applied between the primary transfer rollers 6*a* to 6*d* and the photosensitive drums 1*a* to 1*d*, respectively, at a predetermined transfer voltage. In this manner, the toner images of yellow, magenta, cyan, and black on the respective photosensitive drums 1*a* to 1*d* are primarily transferred onto the intermediate transfer belt 8. Those four-color images are formed with a predetermined positional relationship in order to form a predetermined full-color image. After that, for preparation of subsequent new electrostatic latent image formation, the toners remaining on the surfaces of the photosensitive drums 1*a* to 1*d* are removed by the cleaning devices 5*a* to 5*d*, respectively.

The intermediate transfer belt 8 is looped around a driven roller 12 and the drive roller 13. When the intermediate transfer belt 8 starts to rotate in the counterclockwise direction along with the rotation of the drive roller 13 by a belt drive motor (not shown), the sheet 26 is conveyed from the registration roller pair 14 to a nip portion (secondary transfer nip portion) between the secondary transfer roller 9, which is provided close to the intermediate transfer belt 8, and the intermediate transfer belt 8 at a predetermined timing. Then, at the nip portion, a full-color image is secondarily transferred onto the sheet 26. The sheet 26 onto which the toner image has been transferred is conveyed to the fixing device 7.

The sheet 26 conveyed to the fixing device 7 is heated and pressurized when the sheet 26 passes through a nip portion (fixing nip portion) between a fixing roller pair 15, and thus the toner image thereon is fixed onto the surface of the sheet 26. In this manner, a predetermined full-color image is formed. The sheet 26 onto which the full-color image has been formed passes through a conveyance roller pair 16, and then the conveyance direction of the sheet 26 is sorted by a conveyance guide member 21 arranged at a branch portion of a sheet conveyance path 19. Specifically, the sheet 26 is directly delivered to a delivery tray 18 via a delivery roller pair 24, or the sheet 26 is conveyed to a reverse conveyance path 23 so as to be subjected to double-sided copying, and then delivered to the delivery tray 18 via the delivery roller pair 24.

Specifically, the sheet conveyance path 19 branches into two paths of right and left on the downstream side of the conveyance roller pair 16, and one of the two paths (path branched in the left direction of FIG. 1) is communicated with the delivery tray 18. Further, the other of the two paths (path branched in the right direction of FIG. 1) is communicated with the reverse conveyance path 23.

Figure 2:
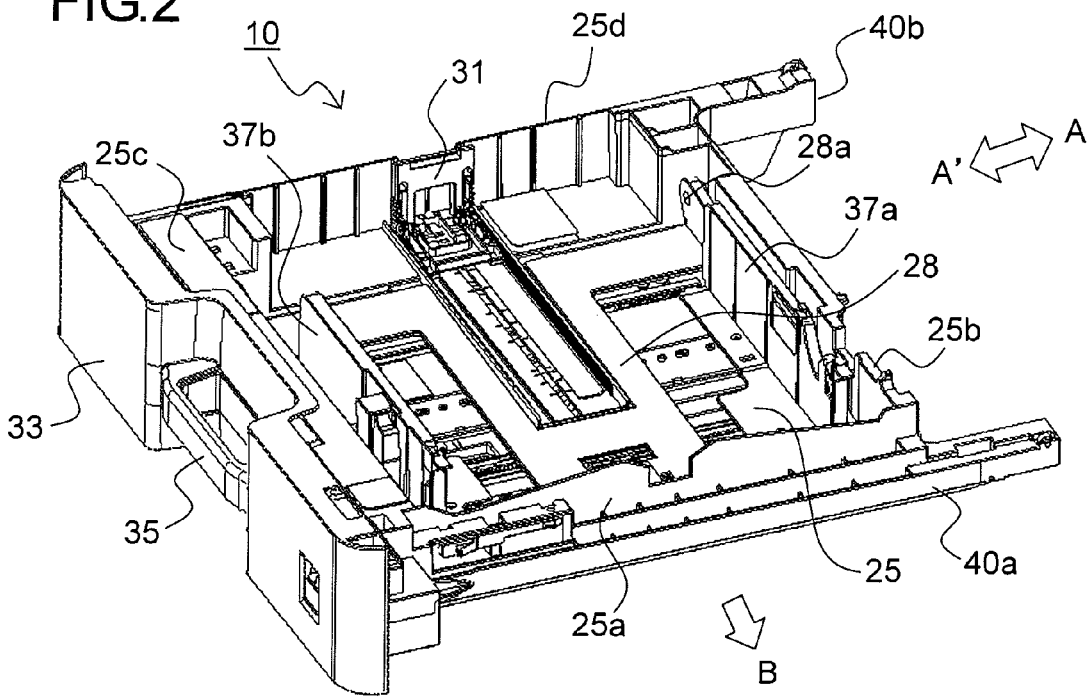
FIG. 2 is a perspective view of the sheet feeding cassette 10 according to an embodiment of the present invention, when viewed from a downstream side in a sheet feeding direction.

Next, the configuration of the sheet feeding cassette 10 is described. FIG. 2 is a perspective view illustrating a state in which the sheet feeding cassette 10 is pulled out from the image forming apparatus 100 main body. In FIG. 2, the arrow A and the arrow A' indicate an inserting direction and a pulling-out direction, respectively, of the sheet feeding cassette 10 with respect to the image forming apparatus 100 main body, and the arrow B indicates a sheet feeding direction of the sheet feeding cassette 10. Wall portions 25*a* to 25*d* are provided upright at four peripheral end portions of a cassette base 25. The cassette base 25 and the wall portions 25*a* to 25*d* form a housing (casing) of the sheet feeding cassette 10.

A cassette cover 33 is mounted onto the wall portion 25*c* on the upstream side with respect to the inserting direction of the sheet feeding cassette 10. The front surface side (left side in FIG. 2) of the cassette cover 33 is exposed to the outside, and this part forms a part of an exterior surface of the image forming apparatus 100 main body (see FIG. 1). Further, at a center portion of the cassette cover 33, there is provided a gripper portion 35 to be used when the sheet feeding cassette 10 is detached and mounted.

The sheet stacking plate 28 onto which the sheets 26 (see FIG. 1) are to be stacked is provided so that an end portion on the downstream side in the sheet feeding direction (direction of the arrow B in FIG. 2) is vertically liftable with respect to the cassette base 25 with pivot shafts 28*a* provided on the right and left sides being a fulcrum. Further, on both sides in a width direction of the sheet stacking plate 28, a pair of width adjusting cursors 37*a* and 37*b* for performing positioning in the width direction of the sheets 26 to be stacked on the sheet stacking plate 28 are provided so as to be reciprocable in the sheet width direction (directions of the arrows A and A' in FIG. 2) along a guide groove formed in the cassette base 25. Further, because the sheet is sent toward the sheet conveyance path 11 (see FIG. 1) in the direction of the arrow B, a trailing end cursor 31 for aligning the trailing ends of the sheets is provided so as to be reciprocable in a direction parallel to the sheet conveyance direction (direction of the arrow B in FIG. 2) along a guide groove formed in the cassette base 25.

The width adjusting cursors 37*a* and 37*b* and the trailing end cursor 31 are moved in conformity to the size of the stacked sheets, and thus, the sheets 26 are stored at a predetermined position inside the sheet feeding cassette 10.

On outer sides of the wall portions 25*a* and 25*d*, which are parallel to the inserting direction or the pulling-out direction (directions of the arrows A and A') of the sheet feeding cassette 10, guide rails 40*a* and 40*b* are arranged adjacent to the wall portions 25*a* and 25*d*, respectively. On the image forming apparatus 100 main body side, a rail support portion (not shown) for slidably supporting the guide rails 40*a* and 40*b* is provided. The guide rails 40*a* and 40*b* are allowed to slide along the rail support portion, and thus the sheet feeding cassette 10 can be inserted into or pulled out from the image forming apparatus 100 main body.

Figure 3:
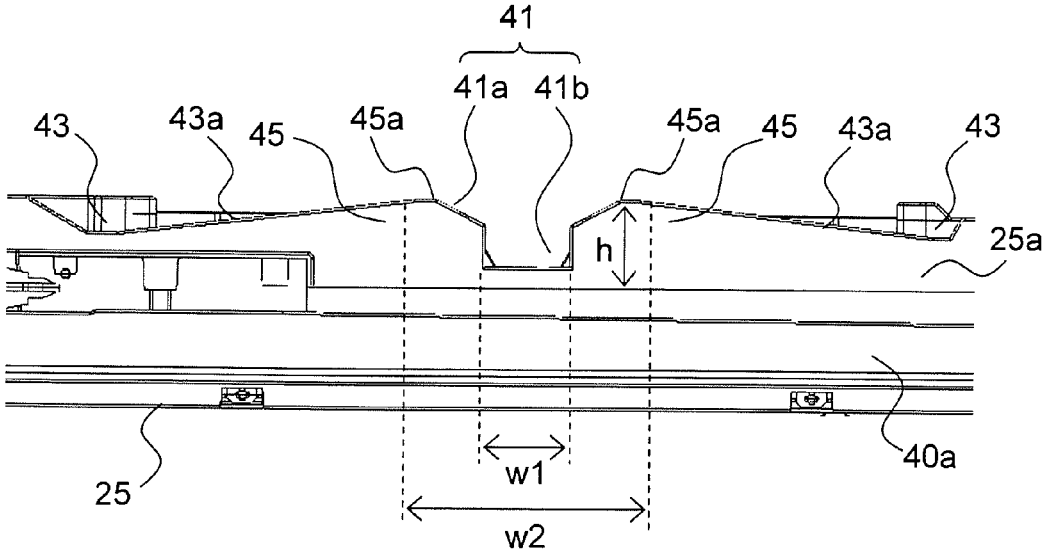
FIG. 3 is a partial side view of the sheet feeding cassette 10 according to the embodiment of the present invention, when viewed from the downstream side in the sheet feeding direction.

FIG. 3 is a partial side view of the sheet feeding cassette 10 viewed from the downstream side in the sheet feeding direction. In the wall portion 25*a* positioned on the downstream side in the sheet feeding direction, three notch portions in total, that is, a first notch portion 41 and second notch portions 43 and 43 are formed. The first notch portion 41, which is formed at a substantially center portion in a longitudinal direction of the wall portion 25*a*, faces the feeding roller 30*a* (see FIG. 1) on the image forming apparatus 100 main body side, and includes a tapered portion 41*a* which widens upwardly and a rectangular extended portion 41*b* provided continuously below the tapered portion 41*a*. The extended portion 41*b* is extended down to the vicinity of a lower end of the wall portion 25*a*, and the extended portion 41*b* is designed to have a width w1 slightly larger than the width of the feeding roller 30*a*.

The two second notch portions 43, which are formed at both end portions in the longitudinal direction of the wall portion 25*a*, each include an inclined surface 43*a* which gently rises toward the first notch portion 41, and there are formed mountain-shaped sheet regulating portions 45 each having a peak 45*a* at a portion at which the inclined surface 43*a* and the tapered portion 41*a* of the first notch portion 41 intersect with each other. The sheet regulating portion 45 is a member for regulating movement in the sheet feeding direction of the sheet inside the sheet feeding cassette 10. The peak 45*a* of the sheet regulating portion 45 is formed on an inner side of a width w2 of a minimum-size sheet storable inside the sheet feeding cassette 10. Further, each of the sheet regulating portions 45 is designed to have a height h which is equal to or larger than the maximum height of the sheets when the maximum amount of sheets storable inside the sheet feeding cassette 10 are stored.

Next, a sheet feeding operation utilizing the sheet feeding cassette 10 of the present invention is described. When a copying start button of the image forming apparatus 100 is turned ON, the lifting mechanism (not shown) raises the sheet stacking plate 28 so that the upper surface of the sheet bundle set on the sheet stacking plate 28 is pressed by the pickup roller 29 at a predetermined pressure. At the same time, the pickup roller 29 and a feeding roller 30*a* of the feeding roller pair 30 (see FIG. 1) start to rotate. Then, the pickup roller 29 and the feeding roller pair 30 separate only the uppermost sheet of the sheet bundle, and the separated sheet is conveyed to the sheet conveyance path 11 (see FIG. 1).

Figure 4:
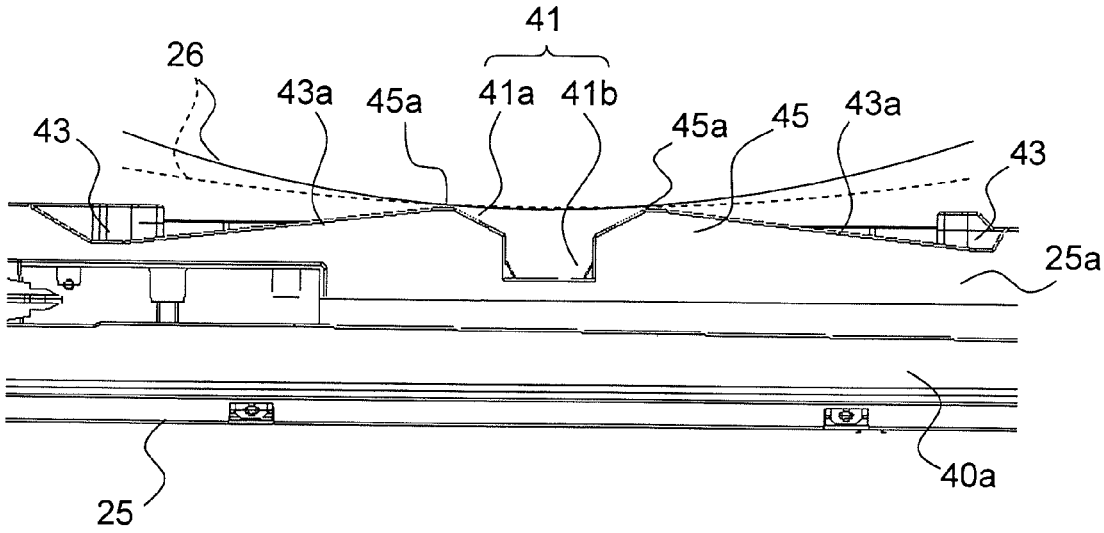
FIG. 4 is a partial side view illustrating a state in which a sheet 26 is fed from the sheet feeding cassette 10 according to the embodiment of the present invention, when viewed from the downstream side in the sheet feeding direction.
Figure 5:
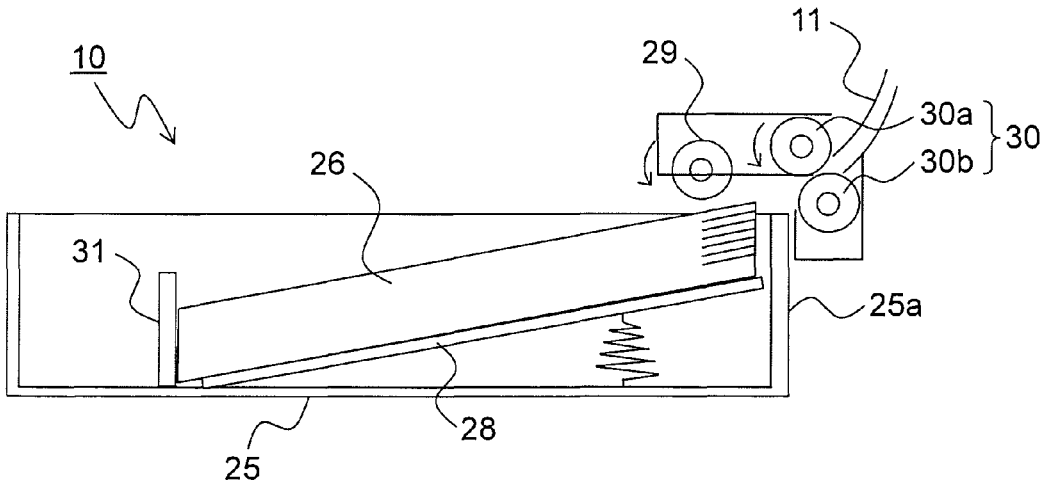
FIG. 5 is a cross-sectional side view illustrating a conventional sheet feeding cassette 10 and a configuration around a feeding roller pair 30 provided on an image forming apparatus 100 main body side.
Figure 6:
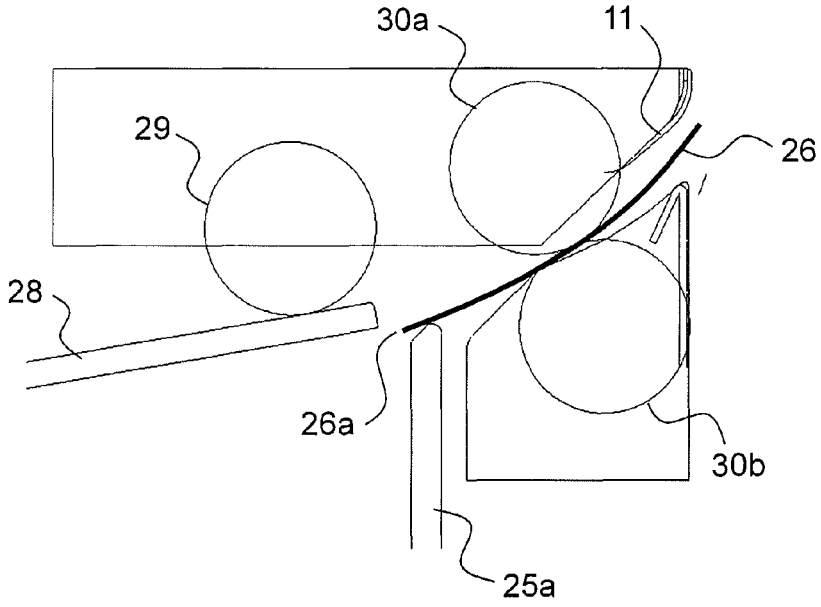
FIG. 6 is a partial cross-sectional view illustrating a state in which, in the conventional sheet feeding cassette 10, a trailing end of a sheet 26 to be fed is passing above a wall portion 25*a* of the sheet feeding cassette 10.

FIG. 4 is a partial side view illustrating a state in which the sheet is fed from the sheet feeding cassette 10, when viewed from the downstream side in the sheet feeding direction. The wall portion 25*a* positioned in the sheet feeding direction has the first notch portion 41 and the second notch portions 43 formed therein, and hence when the trailing end of the sheet 26 passes above the upper end of the wall portion 25*a*, the trailing end of the sheet 26 collides only with the peaks 45*a* of the sheet regulating portions 45. With this, the contact area between the trailing end of the sheet 26 and the wall portion 25*a* is reduced, which makes it possible to reduce the sheet flapping noise.

Further, as illustrated by a solid line in FIG. 4, the sheet 26 is conveyed in the sheet feeding direction while the center portion in the width direction thereof, which is nipped between the feeding roller pair 30, bends downwardly. Here, because the first notch portion 41 is formed at a portion of the wall portion 25*a* facing the feeding roller 30*a*, and the first notch portion 41 includes the tapered portion 41*a* which widens upwardly, it is possible to effectively avoid collision of the bending portion of the sheet 26 and the wall portion 25*a*.

Therefore, in order to reduce the contact between the bending portion of the sheet 26 and the sheet regulating portions 45 as much as possible, it is desired to widen the interval between the peaks 45*a* of the sheet regulating portions 45 as much as possible. In this context, it is preferred to arrange the peaks 45*a* of the sheet regulating portions 45 at positions as far from the first notch portion 41 as possible, that is, at positions on the inner side nearby the end portions in the width direction of the minimum-size sheet width w2 (see FIG. 3). With this, it is possible to minimize the contact between the bending portion of the sheet 26 and the sheet regulating portions 45 while maintaining the function of regulating the movement of the minimum-width sheet 26.

Further, the interval between the peaks 45*a* of the sheet regulating portions 45 is set larger than the width of the feeding roller 30*a*, and hence it is possible to suppress the collision of the bending portion of the sheet 26, which is formed by being nipped between the feeding roller pair 30, and the peaks 45*a* of the sheet regulating portions 45 more effectively.

Note that, the bending amount of the sheet 26 differs depending on the size or the paper thickness of the sheet 26. However, when the sheet 26 has a high stiffness, as illustrated by a broken line in FIG. 4, the bending of the sheet 26 is small, and hence both the end portions in the width direction of the sheet 26 are easily brought into contact with the upper end of the wall portion 25*a*. However, even in this case, both the end portions in the width direction of the sheet 26 do not collide against the wall portion 25*a* at once, and the sheet is fed while both the end portions are sequentially brought into contact with the upper end of the wall portion 25*a* along the inclined surfaces 43*a*. Therefore, it is possible to reduce the sheet flapping noise.

Further, when the sheet bundle is to be set on the sheet stacking plate 28 of the sheet feeding cassette 10, by holding a portion of the sheet bundle near the center in the width direction, and by placing the leading end of the sheet bundle on the sheet stacking plate 28 from the wall portion 25*d* side (trailing end cursor 31 side) and then on the wall portion 25*a* side, the fingers holding the sheet bundle enter the extended portion 41*b* from the tapered portion 41*a* of the first notch portion 41, and hence it is possible to reliably set the sheet bundle down to the bottom surface of the cassette base 25. Meanwhile, in a case where the sheet bundle set in the sheet feeding cassette 10 is to be replaced, by inserting the fingers into the extended portion 41*b* of the first notch portion 41 and holding the lowermost portion of the sheet bundle, the sheet bundle can be taken out at once. With this, the wall portion 25*a* does not disturb the work when the sheet bundle is set or replaced, and hence the workability is improved.

Besides, the present invention is not limited to the embodiment described above, and various modifications may be made thereto without departing from the gist of the present invention. For example, in the embodiment described above, the first notch portion 41 is provided at a portion of the wall portion 25*a* facing the feeding roller 30*a*, and the second notch portions 43 are provided at both the end portions in the longitudinal direction of the wall portion 25*a*. However, without providing the second notch portions 43, only the first notch portion 41 may be provided at a portion of the wall portion 25*a* facing the feeding roller 30*a*. Also in this case, it is possible to reduce the collision with the wall portion 25*a* when the sheet downwardly bends by the nipping of the feeding roller pair 30. Therefore, it is possible to expect the effect of suppressing the sheet flapping noise.

Further, the feeding roller pair 30 is arranged at a center portion in the sheet width direction herein, and hence the first notch portion 41 is also formed at the substantially center portion in the longitudinal direction of the wall portion 25*a*. However, in a case where the feeding roller pair 30 is arranged at other positions, the first notch portion 41 may be also formed at other positions of the wall portion 25*a* in conformity to the position of the feeding roller pair 30.

Still further, the shapes and the sizes of the first notch portion 41 and the second notch portions 43 are not limited to those described in the embodiment above, and may be appropriately set depending on specifications of the sheet feeding cassette and the type of the sheet to be used. For example, the extended portion 41*b* of the first notch portion 41 is not a necessary configuration, and in a case where the sheet setting property to the sheet feeding cassette 10 is not required to be considered, the extended portion 41*b* may be omitted.

The present invention is applicable to a recording medium storage cassette for storing a recording medium of a sheet form. In the present invention, of the plurality of wall portions provided upright at peripheral end portions of the cassette base, the wall portion provided upright in the feeding direction of the recording medium has the first notch portion formed therein, which is opened toward the upper end of the wall portion and formed at the position facing the feeding roller, which is provided on the image forming apparatus main body side.

By utilizing the present invention, it is possible to provide a recording medium storage cassette, which is capable of effectively avoiding the collision of the recording medium and the wall portion provided upright in the feeding direction of the recording medium and reducing the flapping noise, with a simple configuration and at low cost.

What is claimed is:

1. A recording medium storage cassette, detachably mountable to an image forming apparatus main body comprising:

a housing, which is constituted by a cassette base and a plurality of wall portions provided upright at peripheral end portions of the cassette base, for storing a recording medium of a sheet form; and a recording medium stacking plate, which is pivotably provided to the housing and has one end raised and lowered in accordance with a stacking amount of the recording medium, for pressing the recording medium against a pickup roller which is provided on the image forming apparatus main body side;

a first notch portion, which is formed in, among the plurality of wall portions, a wall portion provided upright in a feeding direction of the recording medium, the first notch portion being opened toward an upper end of the wall portion and formed at a position facing a feeding roller pair, which is provided on the image forming apparatus main body side, for separating and feeding the recording medium inside the housing fed from the pickup roller;

second notch portions formed at both end portions in a longitudinal direction of an upper end portion of the wall portion; and recording medium regulating portions formed between the first notch portion and the respective second notch portions, the recording medium regulating portions regulating movement in the feeding direction of the recording medium inside the housing, wherein the recording medium regulating portions each have a mountain shape with a peak when viewed from the feeding direction of the recording medium, the peaks being arranged closely inside width-direction ends of a minimum-width interval that corresponds to the width of a minimum-width recording medium for which the housing is configured to store in a predetermined position, an interval of peaks of the recording medium regulating portions is larger than a width of the feeding roller pair, a height of the peaks of the recording medium regulating portions is equal to or larger than a stacking height of a maximum amount of recording medium storable inside the housing but smaller than a height at which the recording medium stacking plate makes contact with the pickup roller, and the first notch portion has a taper portion which widens toward the peaks.

2. A recording medium storage cassette according to claim 1, wherein the recording medium regulating portions each include an inclined surface and a tapered portion that intersect with each other to form the peak of the mountain shape.

3. A recording medium storage cassette comprising:

a housing, which is constituted by a cassette base and a plurality of wall portions provided upright at peripheral end portions of the cassette base, for storing a recording medium of a sheet form;

a recording medium stacking plate, which is pivotably provided to the housing and has one end raised and lowered in accordance with a stacking amount of the recording medium;

a first notch portion, which is formed in, among the plurality of wall portions, a wall portion provided upright in a feeding direction of the recording medium, the first notch portion being opened toward an upper end of the wall portion and formed at a position facing a feeding roller, which is provided on an image forming apparatus main body side, for feeding the recording medium inside the housing;

second notch portions formed at both end portions in a longitudinal direction of an upper end portion of the wall portion; and recording medium regulating portions formed between the first notch portion and the respective second notch portions, the recording medium regulating portions regulating movement in the feeding direction of the recording medium inside the housing, wherein the recording medium regulating portions each have a mountain shape with a peak, when viewed from the feeding direction of the recording medium, the recording medium storage cassette is detachably mountable to the image forming apparatus main body, and the recording medium regulating portions each include an inclined surface and a tapered portion that intersect with each other to form the peak of the mountain shape.

4. A recording medium storage cassette according to claim 3, wherein an interval between the peaks of the recording medium regulating portions is larger than a width of the feeding roller.

5. A recording medium storage cassette according to claim 4, wherein the peak of each of the recording medium regulating portions is arranged at a position within end portions of a minimum-width interval that corresponds to the width of a minimum-width recording medium for which the housing is configured to store in a predetermined position, when viewed from the feeding direction of the recording medium.

6. A recording medium storage cassette according to claim 3, wherein:

the first notch portion comprises:

a tapered portion, which widens toward the upper end of the wall portion; and an extended portion provided continuously below the tapered portion; and the extended portion is extended down to a vicinity of a lower end of the wall portion.

7. An image forming apparatus, comprising the recording medium storage cassette according to claim 3.

* * * * *